US007444788B2

(12) United States Patent
Morin et al.

(10) Patent No.: US 7,444,788 B2
(45) **Date of Patent: *Nov. 4, 2008**

(54) EXTRUDED PERMANENT FORM-WORK FOR CONCRETE

(76) Inventors: Cecil Morin, 1408-7th Street, Nisku, Alberta (CA) T9E 7P9; Clifford Rondin, 1408-7th Street, Nisku, Alberta (CA) T9E 7P9; Brian Reimer, 4202-37th Avenue, Leduc, Alberta (CA) T9E 6A5; Stanley Lachmansingh, 1408-7th Street, Nisku, Alberta (CA) T9E 7P9

( * ) Notice: Subject to any disclaimer, the term of this patent is extended or adjusted under 35 U.S.C. 154(b) by 1183 days.

This patent is subject to a terminal disclaimer.

(21) Appl. No.: 10/097,644

(22) Filed: Mar. 15, 2002
(Under 37 CFR 1.47)

(65) Prior Publication Data

US 2005/0016083 A1 Jan. 27, 2005

(51) Int. Cl.
*E04B 2/00* (2006.01)

(52) U.S. Cl. ..... 52/425; 52/439; 52/429

(58) Field of Classification Search ..... 52/426, 52/275, 562, 563, 272, 425, 439, 429; 249/191, 249/213, 216, 194
See application file for complete search history.

(56) References Cited

U.S. PATENT DOCUMENTS 4,180,956 A * 1/1980 Gross ..... 52/407.1
5,311,718 A * 5/1994 Trousilek ..... 52/425
5,491,947 A * 2/1996 Kim ..... 52/426
5,608,999 A * 3/1997 McNamara ..... 52/275
5,625,989 A * 5/1997 Brubaker et al. ..... 52/309.12
5,729,944 A * 3/1998 De Zen ..... 52/439
5,740,648 A * 4/1998 Piccone ..... 52/426
5,860,262 A * 1/1999 Johnson ..... 52/426
5,953,880 A * 9/1999 De Zen ..... 52/737.6
6,167,669 B1 * 1/2001 Lanc ..... 52/426
6,189,269 B1 * 2/2001 De Zen ..... 52/220.5
6,212,845 B1 * 4/2001 De Zen ..... 52/607
6,219,984 B1 * 4/2001 Piccone ..... 52/426
6,247,280 B1 * 6/2001 Grinshpun et al. ..... 52/309.12

(Continued)

*Primary Examiner*—Basil Katcheves
(74) *Attorney, Agent, or Firm*—Adrian D. Battison; Ade & Company Inc.

(57) ABSTRACT

A set of extruded panels is provided which can be assembled on site to create a permanent form-work for concrete. The set includes inside and outside extruded side wall panels which are arranged to be connected edge to edge to form inside and outside walls. Longitudinally spaced connecting wall panels span between the inside and outside walls at spaced positions across the width of the walls to hold the walls apart and define a hollow interior therebetween including a plurality of interconnected cells with a plurality of holes for communication of concrete and reinforcing bars between each cell and the next. Each connecting wall panel has T-shaped connectors at each edge for attachment to corresponding C-shaped receptacles on the side wall panels. Rigid foam insulation is inserted at the outside wall. The inside wall panels are arranged to support without bowing cast concrete poured into the interior within each cell and three different arrangements are shown to support the inside wall each including a wall portion at right angles to the inside wall and between the connecting walls. In one, an integral double wall is provided. In a second, a short support wall extends to a supplementary wall parallel to the inside wall and in the third, a support wall identical to the connector walls spans between the inside and outside walls.

9 Claims, 4 Drawing Sheets

U.S. PATENT DOCUMENTS 6,435,471 B1 * 8/2002 Piccone ..... 249/47
6,622,452 B2 * 9/2003 Alvaro ..... 52/742.14
6,694,692 B2 * 2/2004 Piccone ..... 52/426
6,935,081 B2 * 8/2005 Dunn et al. ..... 52/426

* cited by examiner

EXTRUDED PERMANENT FORM-WORK FOR CONCRETE

This invention relates to a set of extruded form-work panels which are interconnected in use to define a form-work for casting of concrete and which are intended to remain in place after the concrete is cured to define inner and outer surfaces of the finished concrete structure.

BACKGROUND OF THE INVENTION

There have been many attempts over the years to generate an alternative form of building construction which utilizes permanent forms into which concrete is poured and cured to provide the structural strength for the exterior form work. The use of plastic extruded panels for the formwork has previously been proposed and these can be readily assembled on sight to provide a structure into which reinforcing bars can be inserted and into which the concrete can be inserted and into which the concrete can be poured. The plastic panels then remain in place forming inside and outside surfaces for the concrete structure thus avoiding the necessity for additional cladding and providing in one step a finished attractive appearance.

One example and arrangement of this type is shown in Canadian Patent 957,816 (Rodighiero et al) issued Nov. 19, 1974 which discloses inside wall panels and outside wall panels which are connected edge to edge so as to form inside and outside walls respectively. The panels are connected edge to edge and supported in their spaced position by transverse connecting walls. Embodiments are disclosed in which an insulation material can be applied between the concrete and one of the side walls. The side wall which supports the concrete is prevented from bowing primarily by transversely extending stiffening ribs. However additional wall portions can be provided connected to the side wall and extending generally at right angles thereto so as to hold the side wall against bowing outwardly under the weight of the concrete.

A further arrangement which has achieved some commercial success is shown in U.S. Pat. No. 5,216,863 (Nessa et al) issued Jun. 8, 1993. This discloses a generally cylindrical structure with one open face where the cylindrical elements slide each into the next using male and female couplings to form a similar permanent form work structure to develop the above patent but in which the structure takes the form of a series of interconnected columns.

Canadian Patents 2,215,939, 2,218,600 and 2,226,497 of Piccone disclose various constructions of form work of a similar nature to that shown in the above patent of Rodighiero but many shaped to form the column structure similar to that of Nessa.

It has been determined recently that the most commercial structure for arrangements of this type is one in which the inside and outside walls are generally flat and of course the materials are kept substantially to a minimum so as to reduce the construction cost of the initial formwork. It is of course important also to minimize the labour involved in assembly of the structures on site.

One problem which arises in meeting the above criteria is to ensure that the structure is stable and prevents the bowing of the side wall which is contact with the concrete.

SUMMARY OF THE INVENTION

It is one object of the present invention, therefore, to provide an improved set of extruded form-work panels for use in defining a form-work for casting of concrete structures.

According to one aspect of the invention there is provided a set of extruded panels for use in constructing a form-work for concrete comprising:

a plurality of first side wall panels which are extruded longitudinally to define a constant cross section along a length of the panel including two opposed side edges and an intermediate panel wall portion and which are arranged to be connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate panel wall portion and which are arranged to be connected edge to edge to form a second side wall with a height of the second side wall defined by the length of the panels and a width of each panel defining a part of a width of the first second wall;

a plurality of connecting wall panels which are extruded longitudinally to define a constant cross section along a length of the panel including two opposed side edges and an intermediate panel wall portion and which are arranged to span between the first and second side walls at spaced positions across the width of the side walls to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector element at one edge for attachment to respective ones of the first wall panels and a second pair of connector element at an opposed edge for attachment to respective ones of the second wall panels;

the first side wall panels being arranged to support without bowing cast concrete poured into the interior within each cell;

the first side wall panels being supported against bowing by a wall portion between the connecting wall panels and extending generally parallel thereto and thus at right angles to the first side wall panel.

Preferably the connecting walls each include a pair of projecting tongues extending therefrom generally at right angles thereto at a position adjacent to and spaced from the second wall panels for locating between the tongues and the second wall panels pieces of rigid foam insulation.

Preferably the second wall panels include a plurality of longitudinally extending ribs, each rib including a pair of sides and a panel portion.

Preferably the connector elements on the connector walls comprise T-shaped members for engagement into co-operating C-shaped members on an inner surface of the first and second panels.

According to a second aspect of the invention there is provided a set of extruded panels for use in constructing a form-work for concrete comprising:

a plurality of first side wall panels which are extruded longitudinally to define a constant cross section along a length of the panel including two opposed side edges and an intermediate panel wall portion and which are arranged to be connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate panel wall portion and which are arranged to be connected edge to edge to form a second side wall with a height of the second side wall defined by the length of the panels and a width of each panel defining a part of a width of the first second wall;

a plurality of connecting wall panels which are extruded longitudinally to define a constant cross section along a length of the panel including two opposed side edges and an intermediate panel wall portion and which are arranged to span between the first and second side walls at spaced positions across the width of the side walls to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector element at one edge for attachment to respective ones of the first wall panels and a second pair of connector element at an opposed edge for attachment to respective ones of the second wall panels;

the first side wall panels being arranged to support without bowing cast concrete poured into the interior within each cell;

the first side wall panels including an outer wall facing outwardly of the interior and an inner wall generally parallel to the outer wall and spaced inwardly therefrom, the outer wall being supported against bowing by a wall portion between the connecting wall panels and extending generally parallel thereto and thus at right angles to the first side wall panel, the wall portion being formed integrally with the inner and outer walls.

Preferably there is provided a plurality of parallel wall portions interconnecting the inner and outer walls.

Preferably the inner wall is closed to prevent entry of concrete between the inner and outer walls.

According to a third aspect of the invention there is provided a set of extruded panels for use in constructing a formwork for concrete comprising:

a plurality of first side wall panels which are extruded longitudinally to define a constant cross section along a length of the panel including two opposed side edges and an intermediate panel wall portion and which are arranged to be connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate panel wall portion and which are arranged to be connected edge to edge to form a second side wall with a height of the second side wall defined by the length of the panels and a width of each panel defining a part of a width of the first second wall;

a plurality of connecting wall panels which are extruded longitudinally to define a constant cross section along a length of the panel including two opposed side edges and an intermediate panel wall portion and which are arranged to span between the first and second side walls at spaced positions across the width of the side walls to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector element at one edge for attachment to respective ones of the first wall panels and a second pair of connector element at an opposed edge for attachment to respective ones of the second wall panels;

the first side wall panels being arranged to support without bowing cast concrete poured into the interior within each cell;

each first side wall panel being associated with a respective one of a plurality of inner walls generally parallel to the side wall panel and spaced inwardly therefrom, the first side wall panel being supported against bowing by a wall portion located between the connecting wall panels and extending generally parallel thereto and thus at right angles to the first side wall panel, the wall portion being connected between the first side panel and the inner wall so as to communicate forces therebetween.

Preferably the inner wall and the wall portion have holes for penetration of concrete.

Preferably the inner wall and the first wall panel each have a female connector thereon for receiving a male connector at the end of the wall portion.

Preferably the female connector comprises a pair of C-shaped receptacles facing each other and the male connectors comprise a pair of T-shaped members back to back.

Preferably the connector elements on the connector walls comprise T-shaped members for engagement into co-operating C-shaped members on an inner surface of the first and second panels.

Preferably the inner wall and the first wall panel are identical.

According to a fourth aspect of the invention there is provided a set of extruded panels for use in constructing a formwork for concrete comprising:

a plurality of first side wall panels which are extruded longitudinally to define a constant cross section along a length of the panel including two opposed side edges and an intermediate panel wall portion and which are arranged to be connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate panel wall portion and which are arranged to be connected edge to edge to form a second side wall with a height of the second side wall defined by the length of the panels and a width of each panel defining a part of a width of the first second wall;

a plurality of connecting wall panels which are extruded longitudinally to define a constant cross section along a length of the panel including two opposed side edges and an intermediate panel wall portion and which are arranged to span between the first and second side walls at spaced positions across the width of the side walls to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector element at one edge for attachment to respective ones of the first wall panels and a second pair of connector element at an opposed edge for attachment to respective ones of the second wall panels;

the first side wall panels being arranged to support without bowing cast concrete poured into the interior within each cell;

each of the first side wall panels being supported against bowing by a wall portion located between the connecting wall panels and extending generally parallel thereto and thus at right angles to the first side wall panel, the wall portion being connected at one end to the first side wall panel and at its other end to the second side wall panel.

Preferably the wall portion and the connecting walls are identical.

Preferably the connector elements on the connector walls comprise T-shaped members for engagement into co-operating C-shaped members on an inner surface of the first and second panels and wherein the wall portion includes T-shaped members identical to those of the connector walls and wherein the first and second wall panels include two C-shaped receptacles facing each other at a mid point on an inside surface thereof for receiving the T-shaped members of the wall portion.

BRIEF DESCRIPTION OF THE DRAWINGS

Three alternative embodiments of the invention will now be described in conjunction with the accompanying drawings in which.

DETAILED DESCRIPTION

Figure 1:
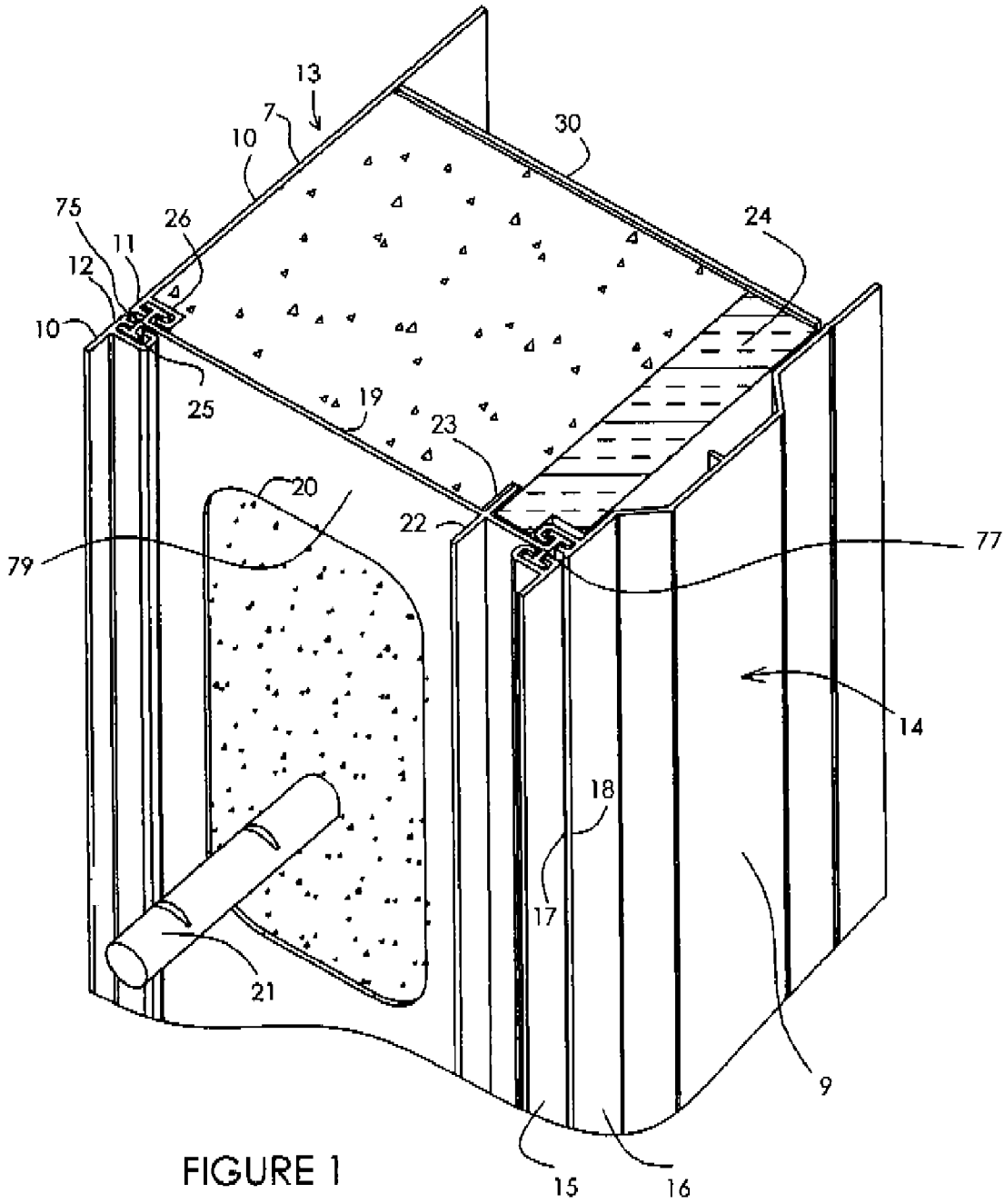
FIG. 1 is an isometric view showing in general a form-work for casting of concrete.

In FIG. 1 is shown a formwork of the general type shown in the above Canadian patent of Rodighiero and as modified by the inclusion of support apparatus 30 (shown schematically in FIG. 1) according to a particular embodiment of the invention. The FIG. 1 construction includes a plurality of inside wall panels 10 which stand vertically upwardly to provide intermediate side wall portions 7 between side edges 11 and 12. Inside wall panels 10 are connected at side edges 11 and 12 to form an inside wall structure 13. A similar outside wall structure 14 includes outside wall panels 15 and 16 which comprise intermediate side wall portions 9 and which are connected together at side edges 17 and 18. Inside wall structure 13 and outside wall structure 14 may be referred to as first and second or inner and outer "side walls" 13, 14. Inside wall panels 10 and outside wall panels 15, 16 may be referred to as first and second "side wall panels" 10, 15, 16.

Inside wall structure 13 and outside wall structure 14 are interconnected by connecting wall panels 19 which bridge the space between side walls 13, 14 and also act to connect together first side wall panels 10 at their side edges 11, 12 and second side wall panels 15, 16 at their side edges 17, 18. Connecting wall panels 19 comprise intermediate connecting wall portions 79 which extend between first and second side edges 75, 77 of connecting wall panels 19. Intermediate connecting wall portions 79 of connecting wall panels 19 include holes 20 which allow concrete poured into the individual cells defined between connecting wall panels 19 to pass between the cells and thus form an integral concrete structure throughout the formwork defined between side walls 13, 14. Prior to pouring the concrete, suitable reinforcing bars 21 can be inserted through aligned holes 20 in connecting wall panels 19.

All of the panels are formed by extrusion so that they have a constant cross section and details of the panels are shown and described in FIGS. 2, 3 and 4 as set out hereinafter.

Connecting wall panels 19 have a pair of right angles tongues 22 and 23 projecting outwardly from the sides thereof parallel to outer side wall 14 and closer to outer side wall 14. Tongues 22, 23 thus define a channel for receiving a portion 24 of rigid foamed insulation material which is cut to the requited shape and inserted into the cell adjacent outer side wall 14 and outside tongues 22 and 23. The concrete is thus restricted to the area between foam insulation material 24 and inner side wall 13.

Connecting wall panels 19 include, at each of first and second side edges 75, 77, a pair of male connectors 25 for insertion into female receptacles 26 at the edges 11 and 12 of inside wall panels 10 and at the edges 17 and 18 of outside wall panels 15, 16.

In between edges 11, 12, it is necessary to provide support for inside wall panels 10 to prevent their bowing inwardly into the building under the weight of the concrete prior to its curing. Thus, inside wall panels 10 are supported by support walls 30 shown schematically in FIG. 1 and shown in further detail and in different alternatives in FIGS. 2, 3 and 4.

Figure 2:
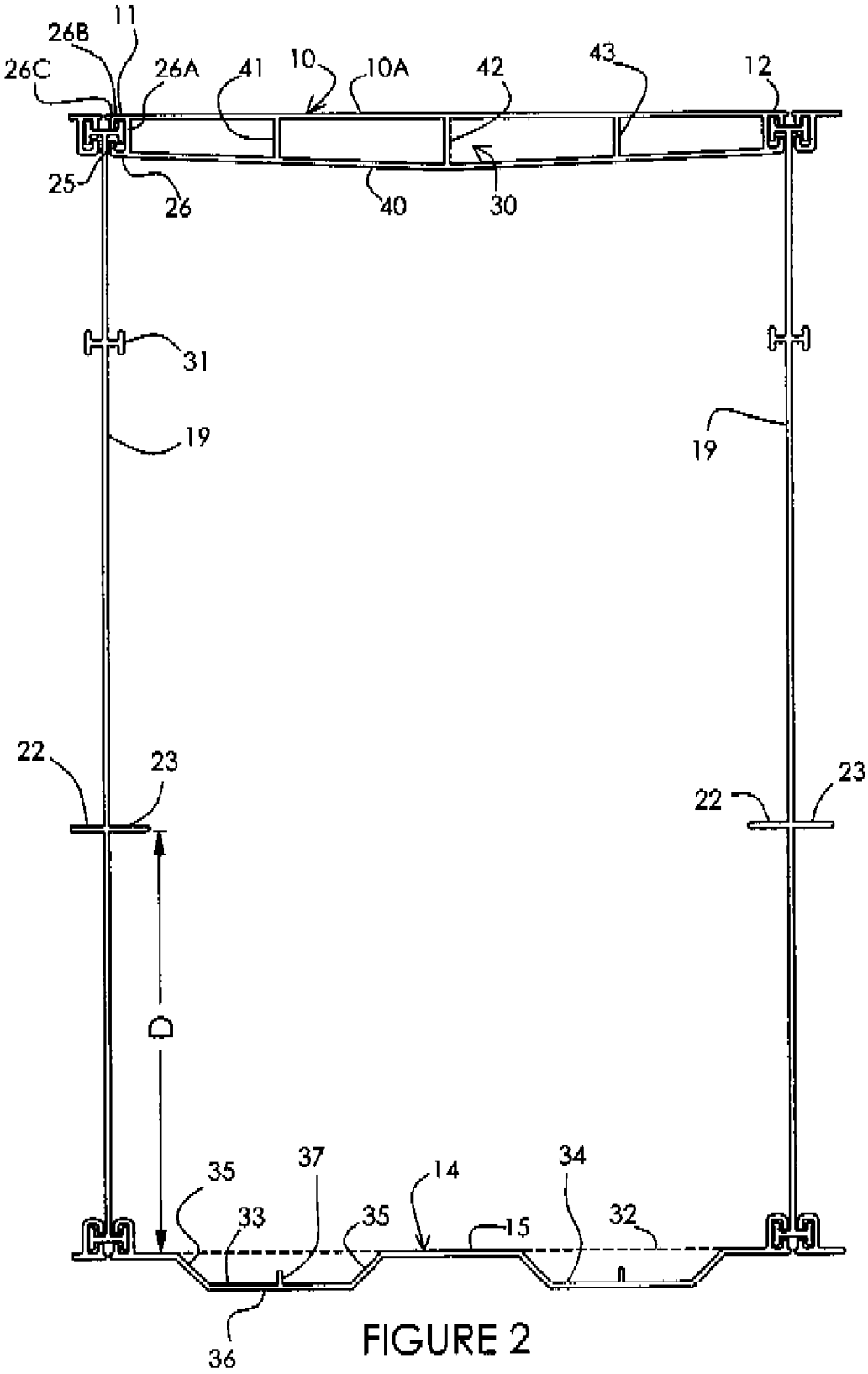
FIG. 2 is a horizontal cross sectional view of a first embodiment of the panels according to the present invention to provide a form-work of the general construction shown in FIG. 1.

Turning firstly to FIG. 2, it will be noted that the male connectors 25 on connecting wall panels 19 are generally T-shaped with a leg of the T connected to each connecting wall panel 19 at its edge and the top of the T generally parallel to connecting wall panel 19.

It will be further noted that female receptacles 26 are generally C-shaped so as to wrap around the top of T-shaped connectors 25. Thus the C-shape includes a base 26A parallel to the top of the T bar and two legs which wrap around the T bar and extend toward the leg of the T bar. Thus the ends of the legs on the inside surface of the T bar lies adjacent or in contact with the respective side surface of connecting wall panel 19. The other leg of the C-shape as indicated at 26B is provided on the exposed surface of inside wall panel 10 and forms a portion or edge 26C which abuts with the corresponding edge of the next adjacent inside wall panel 10 so that connecting wall panel 19 is not itself visible from the outside of the structure. Thus, the interconnections between inside wall panels 10 are in the form of a single vertical line providing an attractive appearance.

The interconnection with outer side wall 14 is identical and is again formed by the T-shaped male members on connecting wall panel 19 and female C shaped receptacles on outside wall panels 15, 16.

Right angled tongues 22 and 23 are visible in FIG. 2 and are spaced from outer side wall 14 by a distance D which is substantially equal to the thickness of the foam insert of insulation material.

An additional T-shaped male member 31 is provided on connecting wall panel 19 at a position adjacent to inside wall panel 10. This is not used in the construction of FIG. 2 but is provided as an alternative mounting arrangement to allow flexibility in the construction to accommodate different structural arrangements and particularly the arrangement shown in FIG. 3 which may be adopted in some circumstances.

Outside wall panels 15, 16 are shaped so as to define a generally flat plane 32 forming a flat outside wall structure 14. However in order to provide an attractive appearance and in order to accommodate expansion and contraction which will occur due to significant temperature changes at the outside surface, outside wall panels 15, 16 include ribs 33 and 34, each of which is defined by an inclined side wall 35, an outer panel portion 36 parallel to plane 32 and a second inclined side wall 35. This arrangement allows the expansion which will occur to be taken up in slight changes in angle in the inclined side walls 35. A projecting flange 37 is provided on the inside of ribs 33, 34. From the aesthetics point of view, therefore, ribs 33, 34 break up the appearance of the flat surface so that any imperfections in what would otherwise be a totally flat surface are not immediately apparent to the eye. Slight changes in angle or surface shape are therefore not visible due to the presence of ribs 33, 34 and the changes of shading which occur due to light patterns formed by those ribs. However the centre section between ribs 33, 34 lies in a common plane 32 and therefore side wall 14 is basically flat.

In the embodiment of FIG. 2, inside wall panel 10 supports the concrete within the cell and is prevented from bowing by the construction generally indicated at 30. In the embodiment of FIG. 2 the arrangement 30 which prevents the bowing is defined by an additional inside wall 40 and three transverse support walls 41, 42 and 43. Inside wall 40 is equal in width to side wall panel 10 and forms a contiguous extension of the inside leg of C-shaped receptacle 26.

The outer wall 10A of side wall panel 10 is integrally extruded with C-shaped receptacles 26, inner wall 40 and transverse support walls 41, 42 and 43 to form an integral closed structure defining four hollow interior cells between transverse support walls 41, 42, 43. Inner wall 40 is fully closed so that concrete is prevented from entering into the hollow interior cells. The width of transverse support wall 42 is slightly greater than that of transverse support walls 41 and 43 and also slightly greater than that of the cross bar 26A of C-shaped receptacle 26, so that inside wall 40 is slightly V-shaped reaching an apex at transverse support wall 42.

The double wall integral structure thus formed as a simple single extrusion of the embodiment of FIG. 2 thus supports the concrete and prevents bowing of inside wall panel 10. The hollow cells can also provide a space for receiving utilities such as wiring and the like.

Figure 3:
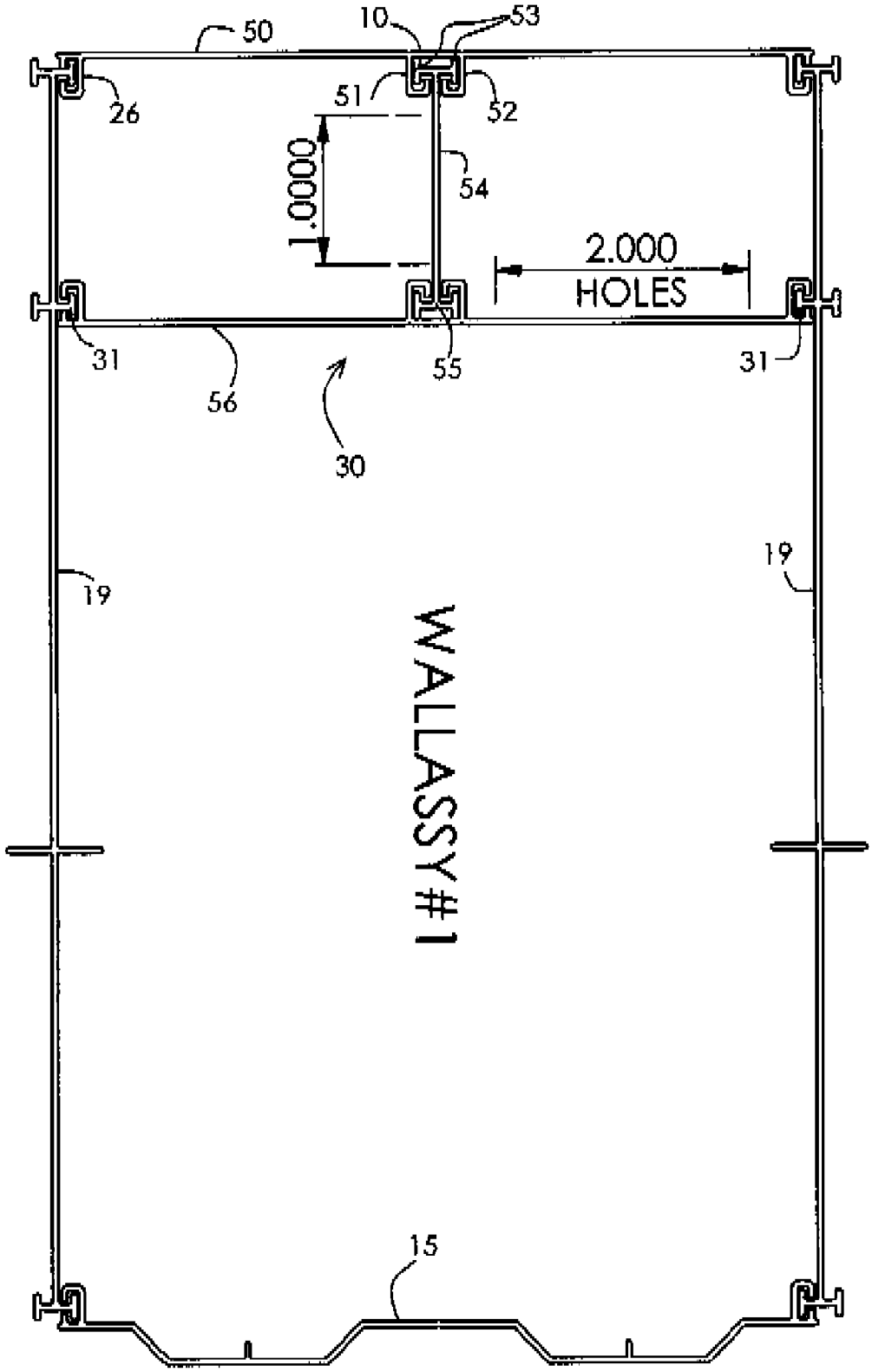
FIG. 3 is a horizontal cross sectional view of a second embodiment of the panels according to the present invention to provide a form-work of the general construction shown in FIG. 1.

Turning now to FIG. 3, there is shown an alternative construction which uses the same connecting wall panels 19 and the same outside wall panels 15, 16 as that of FIG. 2.

In this embodiment, inside wall panel 10 includes the same C-shaped receptacles 26 but is formed only from a single sheet of plastic material as indicated at 50. In this embodiment the single wall panel 50 includes two female receptacles 51 and 52 on its inside surface with the C-shaped receptacles facing each other and spaced so as to receive the T-shaped male members 53 of a supporting wall portion 54. Thus the C-shaped receptacles 51 and 52 include, as one side of the C-shape, single wall panel 50 itself and extend from the panel at right angles to the panel a leg which wraps around the T bar top of T-shaped male members 53.

Supporting wall portion 54 thus is supported by female receptacles 51 and 52 and projects generally at right angles to single wall panel 50 to an opposed end 55 spaced from single wall panel 50.

An additional wall panel 56 which is identical in cross section to inside wall panel 10 is attached to the end 55 of supporting wall portion 54 and to T-shaped members 21 on connecting wall panels 19. Additional wall panel 56 is thus parallel to single wall panel 50 and spaced therefrom across the hollow interior of the cell. Both supporting wall portion 54 and additional wall panel 56 have holes which allow the concrete to pass through those holes from the interior of the cell to enter and fill the rectangular areas between the single wall panel 50 and additional wall panel 56. Thus the whole of the structure is filled with concrete up to single wall panel 50 and additional wall panel 56 and support wall portion 54 are present merely to provide support for single wall panel 50 during installation.

Figure 4:
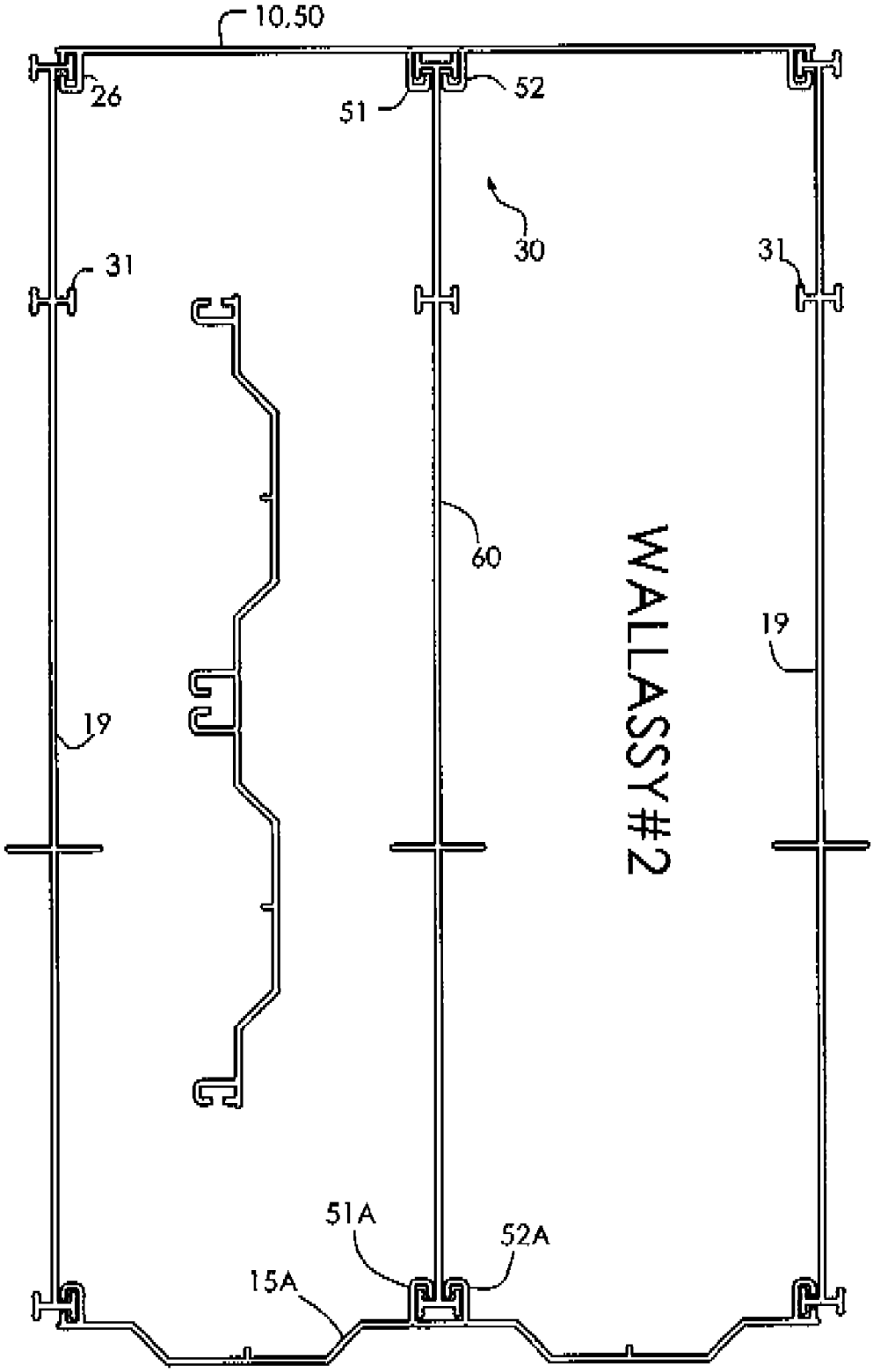
FIG. 4 is a horizontal cross sectional view of a third embodiment of the panels according to the present invention to provide a form-work of the general construction shown in FIG. 1.

Turning now to FIG. 4, there is shown a further alternative arrangement which uses the same inside wall panel 10 (i.e. single wall panel 50) and connecting wall panels 19 as those shown in FIG. 3. Thus, single wall panel 50 is connected using receptacles 26 to the male connectors at the edge of connecting wall panel 19.

In this embodiment, support 30 is provided by an additional support wall 60 which is identical in cross section to connecting wall panels 19 and extends across the full width of the cell from single wall panel 50 of inside wall panel 10 to outside wall panel 15A. Outside wall panel 15A is modified relative to outside wall panel 15 of the previous embodiment by the addition of C-shaped receptacles 51A and 52A identical in construction to the receptacles 51 and 52 on single wall panel 50. Thus, the T-shaped male connectors on the edge of additional support wall 60 are engaged into receptacles 51A and 52A and at the same time the male connectors on the other edge of additional support wall 60 are engaged into receptacles 51 and 52. Thus, additional support wall 60 bridges the whole width of the cell and communicates bowing forces on single wall panel 50 across the width of the structure to outside wall panel 15A.

In this embodiment, the construction is simplified by the fact that additional support wall 60 is identical in cross section to connecting wall panels 19, thus reducing manufacturing cost and inventory problems.

The arrangements described above therefore provide an effective support for the inside wall panel to prevent its bowing while allowing use of simple forms and reducing manufacturing costs by use of the same cross sectional elements at different locations in the structure.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A set of extruded panels defining a form-work for concrete comprising:

a plurality of first side wall panels which are extruded longitudinally to define a constant cross section along a length of the panel including two opposed side edges and an intermediate side wall portion and which are connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate side wall portion and which are connected edge to edge to form a second side wall with a height of the second side wall defined by the length of the panels and a width of each panel defining a part of a width of the second side wall;

a plurality of connecting wall panels which are extruded longitudinally to define a constant cross section along a length of the panel including two opposed side edges and an intermediate connecting wall portion;

each connecting wall panel spanning between the first and second side walls with a first side edge of the connecting wall panel being connected to the side edges of an adjacent pair of the first side wall panels and with a second side edge of the connecting wall panel being connected to the side edges of an adjacent pair of the second side wall panels to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector elements at said first side edge for attachment to respective ones of the adjacent pair of first side wall panels and a second pair of connector elements at said second side edge for attachment to respective ones of the adjacent pair of second side wall panels;

the first side wall panels being arranged to support without bowing cast concrete poured into the interior within each cell;

and a plurality of additional support walls which are extruded longitudinally to define a constant cross section along a length thereof;

each additional support wall being located between a respective pair of the connecting wall panels and extending generally parallel thereto and thus at right angles to the first side wall panels so as to support the first side wall panels against bowing;

each additional support wall being connected at its edges to an inwardly facing surface of the first and second side wall panels at positions thereon spaced from the side edges of the first and second side wall panels;

wherein the first and second pairs of connector elements on the connecting wall panels each comprise a T-shaped member for engagement into a respective co-operating C-shaped member on a respective one of the first and second side wall panels at the respective side edge thereof.

2. The set of extruded panels according to claim 1 wherein the connecting wall panels each include a pair of projecting tongues extending therefrom generally at right angles thereto at a position adjacent to and spaced from the second side wall panels for retaining pieces of rigid foam insulation between the tongues and the second side wall panels.

3. A set of extruded panels defining a form-work for concrete comprising:

a plurality of first side wall panels which are extruded longitudinally to define a constant cross section along a length of the panel including two opposed side edges and an intermediate side wall portion and which are connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate side wall portion and which are connected edge to edge to form a second side wall with a height of the second side wall defined by the length of the panels and a width of each panel defining a part of a width of the second side wall;

a plurality of connecting wall panels which are extruded longitudinally to define a constant cross section along a length of the panel including two opposed side edges and an intermediate connecting wall portion;

each connecting wall panel spanning between the first and second side walls with a first side edge of the connecting wall panel being connected to the side edges of an adjacent pair of the first side wall panels and with a second side edge of the connecting wall panel being connected to the side edges of an adjacent pair of the second side wall panels to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector elements at said first side edge for attachment to respective ones of the adjacent pair of first side wall panels and a second pair of connector elements at said second side edge for attachment to respective ones of the adjacent pair of second side wall panels;

the first side wall panels being arranged to support without bowing cast concrete poured into the interior within each cell;

and a plurality of additional support walls which are extruded longitudinally to define a constant cross section along a length thereof;

each additional support wall being located between a respective pair of the connecting wall panels and extending generally parallel thereto and thus at right angles to the first side wall panels so as to support the first side wall panels against bowing;

each additional support wall being connected at its edges to an inwardly facing surface of the first and second side wall panels at positions thereon spaced from the side edges of the first and second side wall panels;

wherein the first and second pairs of connector elements on the connecting wall panels each comprise a T-shaped member for engagement into a respective co-operating C-shaped member on a respective one of the first and second side wall panels at the respective side edge thereof;

wherein the second side wall panels each include a plurality of longitudinally extending ribs, each rib including a pair of inclined side walls and an outer panel portion.

4. A set of extruded panels defining a formwork for concrete comprising:

a plurality of first side wall panels which are extruded longitudinally to define a constant cross section along a length of the panel including two opposed side edges and an intermediate side wall portion and which are connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate side wall portion and which are connected edge to edge to form a second side wall with a height of the second side wall defined by the length of the panels and a width of each panel defining a part of a width of the second side wall;

a plurality of connecting wall panels which are extruded longitudinally to define a constant cross section along a length of the panel including two opposed side edges and an intermediate connecting wall portion;

each connecting wall panel spanning between the first and second side walls with a first side edge of the connecting wall panel being connected to the side edges of an adjacent pair of the first side wall panels and with a second side edge of the connecting wall panel being connected to the side edges of an adjacent pair of the second side wall panels to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector elements at said first side edge for attachment to respective ones of the adjacent pair of first side wall panels and a second pair of connector elements at said second side edge for attachment to respective ones of the adjacent pair of second side wall panels;

the first side wall panels being arranged to support without bowing cast concrete poured into the interior within each cell;

and a plurality of additional support walls which are extruded longitudinally to define a constant cross section along a length thereof;

each additional support wall being located between a respective pair of the connecting wall panels and extending generally parallel thereto and thus at right angles to the first side wall panels so as to support the first side wall panels against bowing;

each additional support wall being connected at its edges to an inwardly facing surface of the first and second side wall panels at positions thereon spaced from the side edges of the first and second side wall panels;

wherein the additional support walls and the connecting wall panels are identical.

5. The set of extruded panels according to claim 4 wherein the connecting wall panels each include a pair of projecting tongues extending therefrom generally at right angles thereto at a position adjacent to and spaced from the second side wall panels for retaining pieces of rigid foam insulation between the tongues and the second side wall panels.

6. A set of extruded panels defining a form-work for concrete comprising:

a plurality of first side wall panels which are extruded longitudinally to define a constant cross section along a length of the panel including two opposed side edges and an intermediate side wall portion and which are connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate side wall portion and which are connected edge to edge to form a second side wall with a height of the second side wall defined by the length of the panels and a width of each panel defining a part of a width of the second side wall;

a plurality of connecting wall panels which are extruded longitudinally to define a constant cross section along a length of the panel including two opposed side edges and an intermediate connecting wall portion;

each connecting wall panel spanning between the first and second side walls with a first side edge of the connecting wall panel being connected to the side edges of an adjacent pair of the first side wall panels and with a second side edge of the connecting wall panel being connected to the side edges of an adjacent pair of the second side wall panels to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector elements at said first side edge for attachment to respective ones of the adjacent pair of first side wall panels and a second pair of connector elements at said second side edge for attachment to respective ones of the adjacent pair of second side wall panels;

the first side wall panels being arranged to support without bowing cast concrete poured into the interior within each cell;

and a plurality of additional support walls which are extruded longitudinally to define a constant cross section along a length thereof;

each additional support wall being located between a respective pair of the connecting wall panels and extending generally parallel thereto and thus at right angles to the first side wall panels so as to support the first side wall panels against bowing;

each additional support wall being connected at its edges to an inwardly facing surface of the first and second side wall panels at positions thereon spaced from the side edges of the first and second side wall panels;

wherein the additional support walls and the connecting wall panels are identical;

wherein the second wall panels each include a plurality of longitudinally extending ribs, each rib including a pair of inclined side walls and an outer panel portion.

7. A set of extruded panels defining a formwork for concrete comprising:

a plurality of first side wall panels which are extruded longitudinally to define a constant cross section along a length of the panel including two opposed side edges and an intermediate side wall portion and which are connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate side wall portion and which are connected edge to edge to form a second side wall with a height of the second side wall defined by the length of the panels and a width of each panel defining a part of a width of the second side wall;

a plurality of connecting wall panels which are extruded longitudinally to define a constant cross section along a length of the panel including two opposed side edges and an intermediate connecting wall portion;

each connecting wall panel spanning between the first and second side walls with a first side edge of the connecting wall panel being connected to the side edges of an adjacent pair of the first side wall panels and with a second side edge of the connecting wall panel being connected to the side edges of an adjacent pair of the second side wall panels to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector elements at said first side edge for attachment to respective ones of the adjacent pair of first side wall panels and a second pair of connector elements at said second side edge for attachment to respective ones of the adjacent pair of second side wall panels;

the first side wall panels being arranged to support without bowing cast concrete poured into the interior within each cell;

and a plurality of additional support walls which are extruded longitudinally to define a constant cross section along a length thereof;

each additional support wall located between a respective pair of the connecting wall panels and extending generally parallel thereto and thus at right angles to the first side wall panels so as to support the first side wall panels against bowing;

each additional support wall being connected at its edges to an inwardly facing surface of the first and second side wall panels at positions thereon spaced from the side edges of the first and second side wall panels;

wherein the first and second pairs of connector elements on the connecting wall panels each comprise a T-shaped member for engagement into a respective co-operating C-shaped member on a respective one of the first and second side wall panels at the respective side edge thereof;

and wherein each of the additional support walls includes T-shaped members identical to those of the connecting wall panels and wherein the first and second side wall panels include two C-shaped receptacles facing each other at a mid point on an inside surface thereof for receiving the T-shaped members of the additional support wall.

8. The set of extruded panels according to claim 7 wherein the connecting wall panels each include a pair of projecting tongues extending therefrom generally at right angles thereto at a position adjacent to and spaced from the second side wall panels for retaining pieces of rigid foam insulation between the tongues and the second side wall panels pieces of rigid foam insulation.

9. A set of extruded panels defining a form-work for concrete comprising:

a plurality of first side wall panels which are extruded longitudinally to define a constant cross section along a length of the panel including two opposed side edges and an intermediate side wall portion and which are connected edge to edge to form a first side wall with a height of the first side wall defined by the length of the panels and a width of each panel defining a part of a width of the first side wall;

a plurality of second side wall panels which are extruded longitudinally to define a constant cross section along a length of the panel including two opposed side edges and an intermediate side wall portion and which are connected edge to edge to form a second side wall with a height of the second side wall defined by the length of the panels and a width of each panel defining a part of a width of the second side wall;

a plurality of connecting wall panels which are extruded longitudinally to define a constant cross section along a length of the panel including two opposed side edges and an intermediate connecting wall portion;

each connecting wall panel spanning between the first and second side walls with a first side edge of the connecting wall panel being connected to the side edges of an adjacent pair of the first side wall panels and with a second side edge of the connecting wall panel being connected to the side edges of an adjacent pair of the second side wall panels to hold the first and second walls apart and define a hollow interior therebetween including a plurality of cells formed between each connecting wall panel and the next;

each connecting wall panel having a plurality of holes for communication of concrete and reinforcing bars between each cell and the next;

each connecting wall panel having a first pair of connector elements at said first side edge for attachment to respective ones of the adjacent pair of first side wall panels and a second pair of connector elements at said second side edge for attachment to respective ones of the adjacent pair of second side wall panels;

the first side wall panels being arranged to support without bowing cast concrete poured into the interior within each cell;

and a plurality of additional support walls which are extruded longitudinally to define a constant cross section along a length thereof;

each additional support wall located between a respective pair of the connecting wall panels and extending generally parallel thereto and thus at right angles to the first side wall panels so as to support the first side wall panels against bowing;

each additional support wall being connected at its edges to an inwardly facing surface of the first and second side wall panels at positions thereon spaced from the side edges of the first and second side wall panels;

wherein the first and second pairs of connector elements on the connecting wall panels each comprise a T-shaped member for engagement into a respective co-operating C-shaped member on a respective one of the first and second side wall panels at the respective side edge thereof;

and wherein each of the additional support walls includes T-shaped members identical to those of the connecting wall panels and wherein the first and second side wall panels include two C-shaped receptacles facing each other at a mid point on an inside surface thereof for receiving the T-shaped members of the additional support wall;

wherein the second wall panels each include a plurality of longitudinally extending ribs, each rib including a pair of inclined side walls and an outer panel portion.

* * * * *